US005334062A

United States Patent [19]

Lurbiecki

[11] Patent Number: 5,334,062

[45] Date of Patent: Aug. 2, 1994

[54] SELF-SYNCHRONIZING HYDRAULIC CONTROL SYSTEMS FOR MARINE ENGINE TRANSMISSIONS

[76] Inventor: Fred Lurbiecki, 21764 61st Ave., Langley, British Columbia, Canada, V3A 6H4

[21] Appl. No.: 17,807

[22] Filed: Feb. 16, 1993

[51] Int. Cl.[5] ..... B63H 21/26

[52] U.S. Cl. ..... 440/86; 60/571

[58] Field of Search ..... 440/49, 53, 61, 75, 440/85, 86, 87; 60/571, 572, 573

[56] References Cited

U.S. PATENT DOCUMENTS

| | | | |
|---|---|---|---|
| 928,100 | 7/1909 | Berry . | |
| 1,769,809 | 7/1930 | Titus et al. . | |
| 2,112,466 | 3/1938 | Maloon . | |
| 2,657,536 | 11/1953 | Levy . | |
| 3,242,675 | 3/1966 | Norton . | |
| 3,502,002 | 3/1970 | Whiteman, Jr. . | |
| 3,579,989 | 5/1971 | Stark . | |
| 3,823,561 | 7/1974 | Zoppi . | |
| 3,832,852 | 9/1974 | Schmucker . | |
| 3,913,517 | 10/1975 | Lohse et al. | 440/61 |
| 4,255,930 | 3/1981 | Natalie . | |
| 4,449,470 | 5/1984 | Rump | 440/61 |
| 4,463,563 | 8/1984 | Krehbiel . | |
| 4,490,120 | 12/1984 | Hundertmark | 440/61 |
| 4,592,732 | 6/1986 | Ferguson | 440/61 |
| 4,866,937 | 9/1989 | Leigh-Monstevens . | |
| 4,922,120 | 5/1990 | Becker et al. . | |
| 5,058,385 | 10/1991 | Everett, Jr. . | |

FOREIGN PATENT DOCUMENTS

| | | | |
|---|---|---|---|
| 2069057A | 8/1981 | United Kingdom . | |
| 2197275 | 5/1988 | United Kingdom | 440/86 |

OTHER PUBLICATIONS

Kobelt Manufacturing Co. Ltd., 2090 Series Two Station Single Lever Controls Brochure.

*Primary Examiner*—Stephen P. Avila

*Attorney, Agent, or Firm*—Hughes, Multer & Schacht

[57] ABSTRACT

A hydraulic control system comprising master and slave pressure units having pistons and which are filled with fluid. The master piston is connected to a control lever, while the slave piston is connected to an object to be controlled such as a clutch lever on a marine engine. Hoses so interconnect the master and slave pressure units that movement of the control lever moves the master piston and causes fluid to act on the slave piston to cause the piston to move and thus move the clutch lever. A port is formed in the casing of one of the master or slave pressure units. This port is formed to allow communication between a reservoir of fluid and the casing. Given that chambers are formed on either side of the pistons within their respective casings, the port is so arranged that each of these chambers is placed in fluid communication with the reservoir at least once during the stroke cycle of the master piston (i.e., from begining to end and back to the beginning of the stroke).

11 Claims, 9 Drawing Sheets

SELF-SYNCHRONIZING HYDRAULIC CONTROL SYSTEMS FOR MARINE ENGINE TRANSMISSIONS

TECHNICAL FIELD

The present invention relates to hydraulic control systems for marine transmissions, and, more specifically, to hydraulic control systems for such transmissions that remain synchronized despite loss of system fluid.

BACKGROUND OF THE INVENTION

The direction of a boat propellor is often controlled by a clutch control valve that controls the boat transmission. The clutch control valve is operated by a lever which, when moved in one direction, results in the propellor rotating in a direction that causes the boat to move forward and, when moved in an opposite direction, results in the propellor rotating in a drection that causes the boat to move in reverse. When the clutch lever is in a middle position, the clutch is engaged and the engine is in neutral.

A control system is usually employed to allow an operator to operate the clutch lever of an engine mounted below decks from the bridge of the boat. The control system usually comprises a control lever mounted in the bridge and means for transferring movement of the control lever to the clutch lever.

Several basic control systems are known that allow a remotely placed control lever to operate a clutch lever mounted on an engine. One such system is a cable based system that employs cables to transfer movement of the control lever to the clutch lever. An example of such a cable based system is shown in a sales brochure for the 2090 Series Two Station Lever Controls sold by Kobelt Manufacturing Co. Ltd of British Columbia, Canada. These cable based systems have been dissatisfactory because they are susceptible to corrosion caused by environmental factors. Further, the cables of such systems tend to stretch and therefore require frequent adjustment.

Hydraulic control systems have also employed to transfer movement of a control lever to that of a clutch lever. Hydraulic control systems employ master and slave pistons and a flowable working medium to transfer movement of the control lever to the clutch lever. These systems, while less susceptible to environmental factors than cable based systems, tend to suffer slow leaks where the piston shafts enter the cylinders. Over time, such leaks cause the master piston at the control lever come out of alignment, or synchronization, with the slave piston at the clutch lever. When the pistons of a hydraulic system are not synchronized as just-described, the control lever may indicate that the engine is in neutral when this is not the case. Should the pistons come out of synchronization, the hydraulic fluid must be removed from the system, the pistons adjusted, and the lines refilled. While systems for synchronizing hydraulic control systems are available, these synchronizing systems tend to be complex and expensive and are thus inappropriate for use with hydraulic systems for controlling marine transmissions where low cost and simplicity are required. Hydraulic control systems thus have not had great acceptance as control systems for marine transmissions.

It should be noted that the present invention is particularly useful when employed as a control system for controlling the transmission of a marine engine, and that application is described in detail herein. However, while the present invention is particularly effective when applied to such marine transmission control systems, the principles of the present invention may have application to other types of hydraulic control systems. The scope of the present invention is therefore to be determined by the attached claims and not the following detailed description.

OBJECTS OF THE INVENTION

In view of the foregoing, it is apparent that an important object of the present invention is to provide an improved system for controlling marine transmissions.

Another important, but more specific, object of the present invention is to provide control system of r marine transmissions having a favorable mix of the following factors:

a. reduced susceptibility to environmental factors;
b. inexpensively manufactured;
c. increased reliability due to simplicity of construction; and
d. maintains the master and slave pistons of a hydraulic contol system in synchronism.

SUMMARY OF THE INVENTION

These and other objects are achieved by the present invention, which basically comprises master and slave pressure units having pistons and which are filled with fluid. The master piston is connected to a control lever, while the slave piston is connected to an object to be controlled such as a clutch lever on a marine engine. Hoses so interconnect the master and slave pressure units that movement of the control lever moves the master piston and causes fluid to act on the slave piston to cause the piston to move and thus move the clutch lever.

Importantly, a port is formed in the casing of one of the master or slave pressure units. This port is formed to allow communication between a reservoir of fluid and the casing. Given that chambers are formed on either side of the pistons within their respective casings, the port is so arranged that each of these chambers is placed in fluid communication with the reservoir at least once during the stroke cycle of the master piston (i.e., from begining to end and back to the beginning of the stroke).

More particularly, if first and second chambers are defined within the master casing on either side of the master piston, the port is so located in the first casing that fluid can flow from the reservoir into the first chamber only when the volume of the second chamber is substantially at a minimum and from the reservoir into the second chamber only when the volume of the second chamber is substantially at a minimum.

Thus, at least once during each stroke cycle of the master piston, any minor amounts of fluid lost during the normal operation of the system are compensated for to prevent the system from coming out of synchrony.

One port and unpressurized reservoir may thus be employed to maintain the control system in synchronism. The present invention thus allows movement of a control lever to be transferred to a distal clutch lever with a simple and reliable system.

This system also lends itself to being implemented with one master pressure unit and a plurality of slave pressure units. This system also can be made to place itself back into synchrony by forming a port as described above in each of the pressure unit casings and connecting these ports to the reservoir.

DETAILED DESCRIPTION OF THE INVENTION

Figure 1:
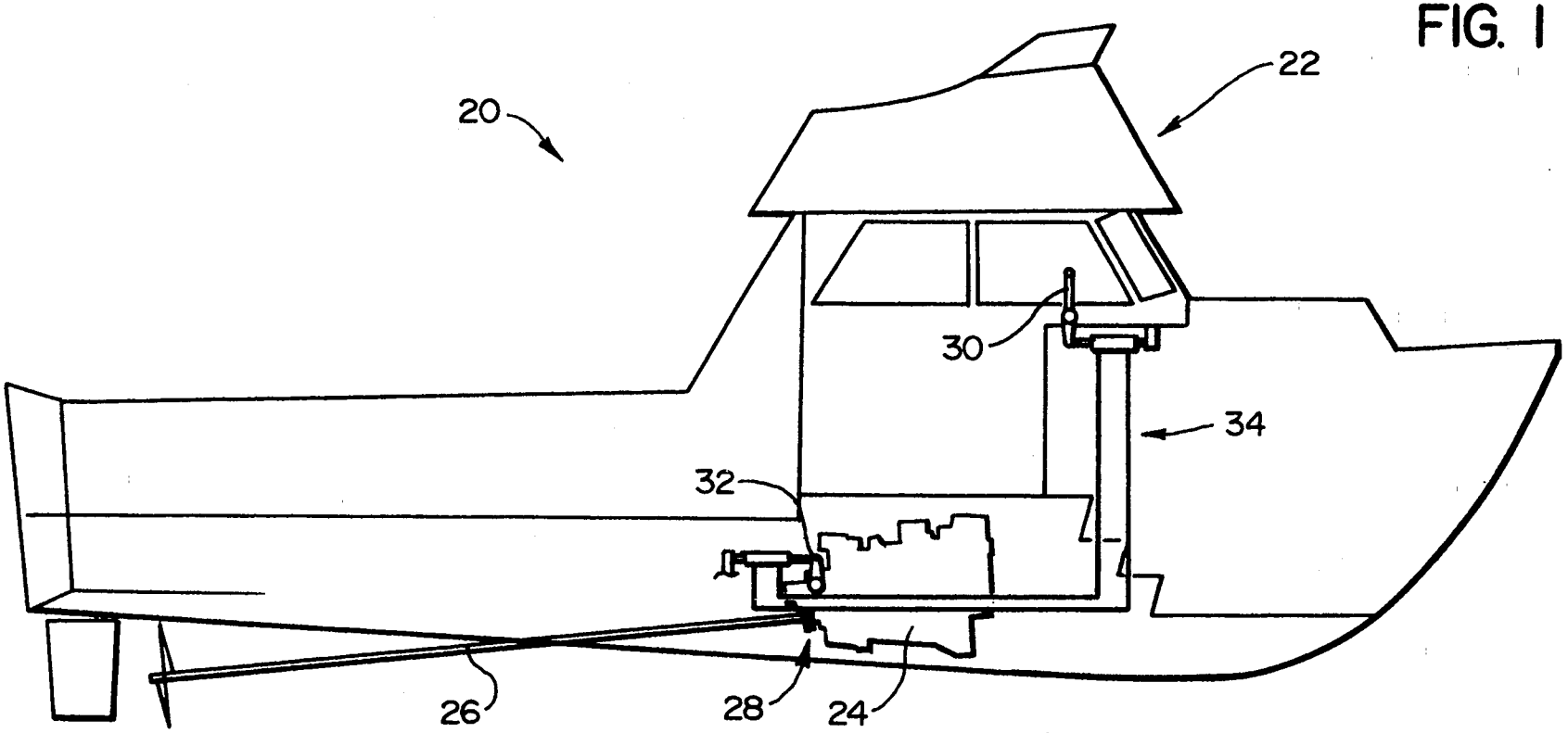
FIG. 1 is a side schematic view of a marine vessel incorporating a first exemplary hydraulic control system constructed in accordance with, and embodying, the principles of the present invention.

Referring now to the drawing, depicted in FIG. 1 is a vessel 20 having a bridge 22, an engine 24, a propellor shaft 26, and a transmission assembly 28 for coupling the engine 24 to the propellor shaft 28.

The vessel 20, bridge 22, engine 24, and propellor shaft 26 are well-known in the art and will be discussed below only to the extent necessary for a complete understanding of the present invention.

The transmission assembly 28 further comprises a control lever 30, a clutch lever 32, and a hydraulic control system 34 for transmitting motion of the control lever 30 to the clutch lever 32. The hydraulic control system 34 is constructed in accordance with, and embodies, the principles of the present invention. As will be described in further detail below, the hydraulic control system 34 allows an operator to move the control lever 32 to operate the distally and inconveniently located clutch lever 32.

Figure 2:
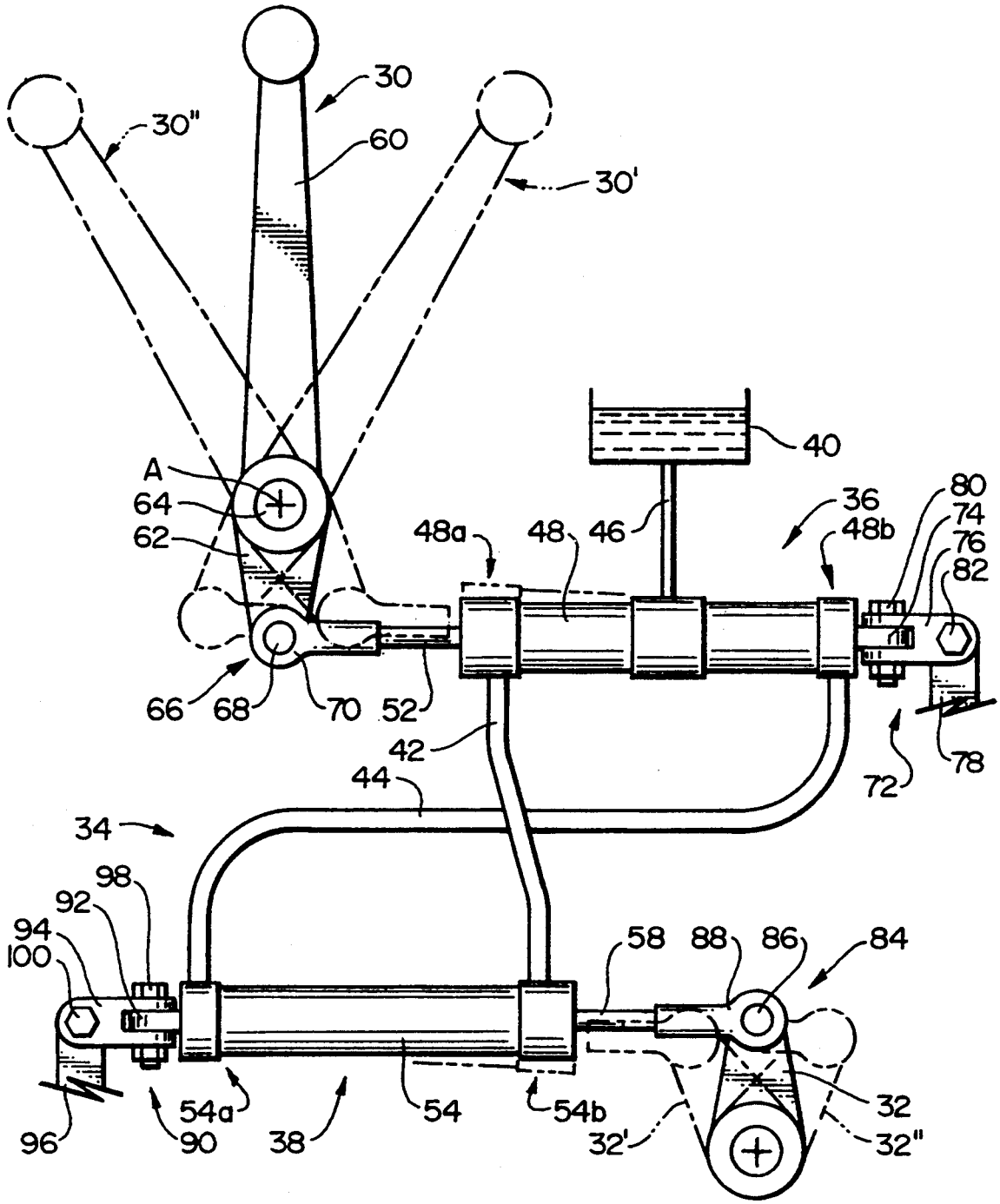
FIG. 2 depicts the physical interconnection of the first exemplary hydraulic control system.

Referring to FIG. 2, the control system 34 will be described in further detail. This system 34 basically comprises a first or master pressure unit 36, a second or slave pressure unit 38, a reservoir 40, and first, second, and third flexible pressure hoses 42, 44, and 46. The reservoir 40 is physically mounted above the system 34.

Figure 3:
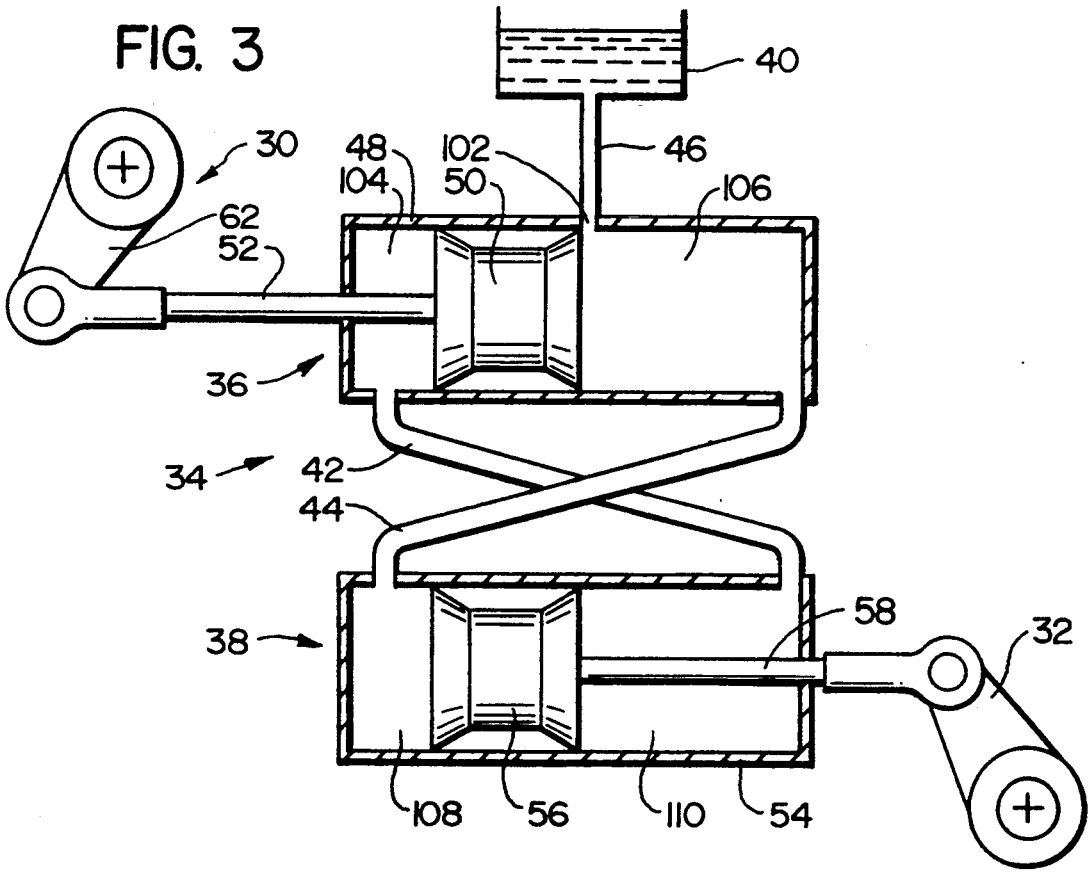
FIGS. 3–6 schematically depict the operation of the first exemplary hydraulic control system shown in FIG. 2.

Referring now for a moment to FIG. 3, it can be seen that the master pressure unit 36 comprises a casing 48, a piston 50, and a piston shaft 52 extending from a first end 48*a* of the casing 48; similarly, the slave pressure unit 38 comprises a casing 54, a piston 56, and a piston shaft 58 extending from a second end 54*b* of the casing 54.

The first hose 42 is connected to the first end 48*a* of the master casing 48 and to the second end 54*b* of the slave casing 54. The second hose 44 is similarly connected to a second end 48*b* of the master casing 48 and to a first end 54*a* of the slave casing 54. The third hose 46 connects the reservoir 40 to the master casing 48.

This system 34 operates basically as follows. Operation of the control lever 30 causes the master piston 50 so to move within the master casing 48 that a flowable working medium such as hydraulic fluid within the master casing 48 flows within the hoses 42 and 44 to the slave casing 54; this fluid acts on the slave piston 56 to cause the slave piston 56 to move within the slave cylinder 54. As long as the master and slave pisons are initially synchronized (reach the ends of their stroke at the same time), they will remain synchronized as long is no fluid is lost from the system 34.

If, however, only a minor amount of fluid is lost from the system 34, the hose 46 so connects the reservoir 40 to either the master or slave casings, in this case the master casing 48, that this lost fluid will be continuously replaced with fluid from the reservoir, thus maintaining the pistons 50 and 56 in synchronism. More particularly, the hose 46 is so connected to the master casing 48 that fluid can flow from the reservoir 40 into the master casing only when the master piston is at either end of its stroke. Any minor amount of fluid lost, such as where the piston shafts 52 and 58 enter the casings 48 and 54, is replenished before the pistons 50 and 56 come out of synchronization.

A more detailed discussion of the present invention will now be presented. Referring back to FIG. 2, that figure shows that the control lever 30 has an upper portion 60 and a lower portion 62. The control lever 30 is so pivotally connected by a pin 64 to a structural member in the bridge 22 that the upper and lower portions 60 and 62 thereof rotate in arcs about an axis A of the pin 64. In the exemplary system 34, the control lever 30 moves between a first position indicated by dashed lines at 30′ and a second position indicated by dashed lines at 30″. The control lever depicted in solid lines by reference character 32 is in a middle position.

Indicated at 66 in FIG. 2 is a first connecting assembly comprising a ball 68 and a socket 70. The ball 68 is attached to the lower portion 62 of the lever 30, and the socket 70 is attached to the piston shaft 52 of the master unit 36. The first connecting assembly transfers arcuate motion of the lower end 62 of the lever 30 into a reciprocating motion of the piston shaft 52.

A second end 48*b* of the master pressure unit casing 48 is connected by a second connecting assembly 72 to a structural member on the bridge 22. This second connecting assembly 72 comprises a first flange 74 extending from the casing 48, an intermediate member 76, and a second flange 78 secured to the structural member on the bridge 22. First and second bolts 80 and 82 join the first flange 74 to the intermediate member 76 and the intermediate member 76 to the second flange 78, respectively. The second connecting assembly 72 allows the casing 48 to pivot relative to the bridge structural member about axes defined by the first and second bolts 80 and 82.

The clutch lever 32 is connected to the slave piston shaft 58 by third connecting assembly 84 similar to the first connecting assembly 66 described above. The third connecting assembly 84 also comprises a ball 86 and a socket 88. The first end 54*a* of the slave casing 54 is connected to a structural member of the vessel 20 by a fourth connecting assembly 90 similar to the second connecting assembly 72 described above. The fourth connecting assembly 90 comprises a first flange 92 extending from the slave casing 54, an intermediate member 94, a second flange 96 secured to the structural member, and first and second bolts 98 and 100 that join the first flange 74 to the intermediate member 76 and the intermediate member 76 to the second flange 78, respectively.

Assembled as just described above, movement of the control lever upper portion 60 causes arcuate movement of the control lever lower portion 62. This arcuate movement of the lower portion 62 causes axial displacement of the master piston shaft 52 and thus displaces the master piston 50 within the master casing 48. Fluid displaced by the master piston 50 as this piston 50 moves flows within the cylinder 48 acts on and displaces the slave piston 56 within the slave casing 54. This causes an axial movement of the slave piston shaft 58, which in turn rotates the clutch lever 32 between a forward position indicated by dotted lines at 32' and a reverse position indicated by dotted lines at 32''; the clutch lever depicted by solid lines at 32 in FIG. 2 is in a neutral position. The first through fourth connecting assemblies 66, 72, 84 and 90 allow the movement of the casings 48 and 50 and axial rotation of the piston shafts 52 and 58 necessary to combine arcuate movement of the levers 30 and 32 with axial or linear movement of the pistons 50 and 56.

From the foregoing, it should be clear that the first position of the control lever 30' corresponds to the forward position of the clutch lever 32', the second position of the control lever 30'' corresponds to the reverse position of the clutch lever 32'', and the middle position of the control lever 30 corresponds to the neutral position of the clutch lever 32.

Figure 4:
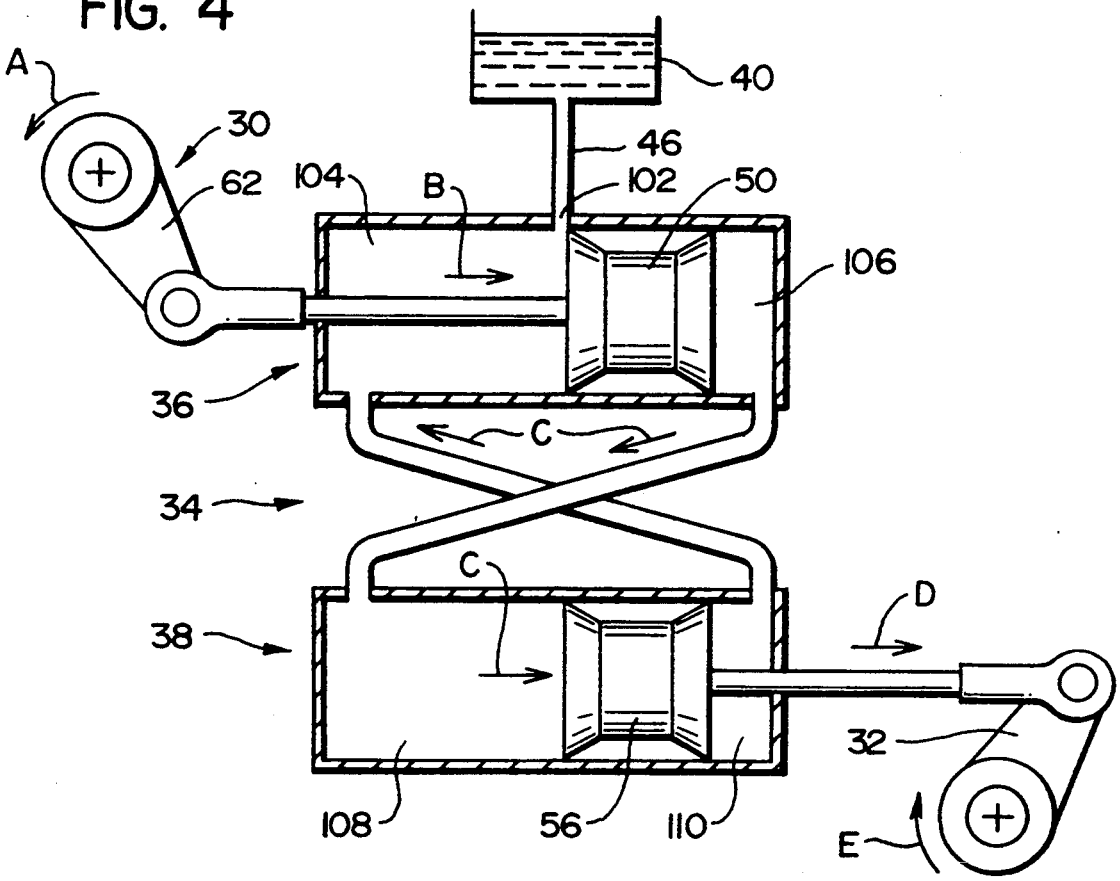

Referring now to FIG. 3, depicted therein is a port 102 through which fluid in the reservoir 40 and third hose 46 flows into the master casing 48. Also, FIG. 3 shows that within the casings 48 and 54, at least four chambers are defined: first and second chambers 104 and 106 within the master casing 48 and third and fourth chambers 108 and 110 within the slave casing 54. As shown in FIG. 3, the volumes of the first and third chambers 104 and 108 are at a minimum, while the volumes of the second and fourth chambers 106 and 110 are at a maximum. In FIG. 4, the situation is reversed, and the volumes of the first and third chambers 104 and 108 are at a maximum, while the volumes of the second and fourth chambers 106 and 110 are at a minimum.

In the exemplary system 34, the volume of fluid in the first chamber 104, fourth chamber 110, and first hose 42 is substantially the same as that in the second chamber 106, third chamber 108, and second hose 44. Additionally, the port 102 is generally located in the middle of the master casing 48. So arranged, the port 102 allows fluid to flow from the reservoir 40 into the first cheer 104 only when the volume of the second chamber 106 is substantially at a minimum and from the reservoir 40 into the second chamber 106 only when the volume of the first chamber 104 is substantially at a minimum.

Throughout this discussion, the master piston 50 will be considered as being at the beginning of its stroke and the slave piston 56 at the end of its stroke when the volume of the first chamber 104 is at a minimum (FIG. 3); it follows that the slave piston 56 will be considered as being at the beginning of its stroke and the master piston 50 at the end of its stroke when the volume of the second chamber 104 is at a minimum (FIG. 4).

Referring now to FIGS. 3–7, the operation of the system 34 will be described in further detail. Starting with the control lever in the first position and the cluth lever 32' in the forward position, rotating the control lever 30 into the second position as shown by arrow A in FIG. 4 causes the master piston 50 to move as shown by arrow B. Movement of the master piston 50 in the direction of arrow B causes fluid to flow throughout the system 34 as shown by arrows C. Specifically, fluid flows from the chamber 106 into the chamber 108 and from the chamber 110 into the chamber 104. The fluid filling the chamber 108 acts on the piston 56 to cause the piston 56 to move in the direction shown by arrow D. This rotates the clutch lever 32 from the foward position (through the neutral position) into the reverse position shown by arrow E in FIG. 4.

Figure 5:
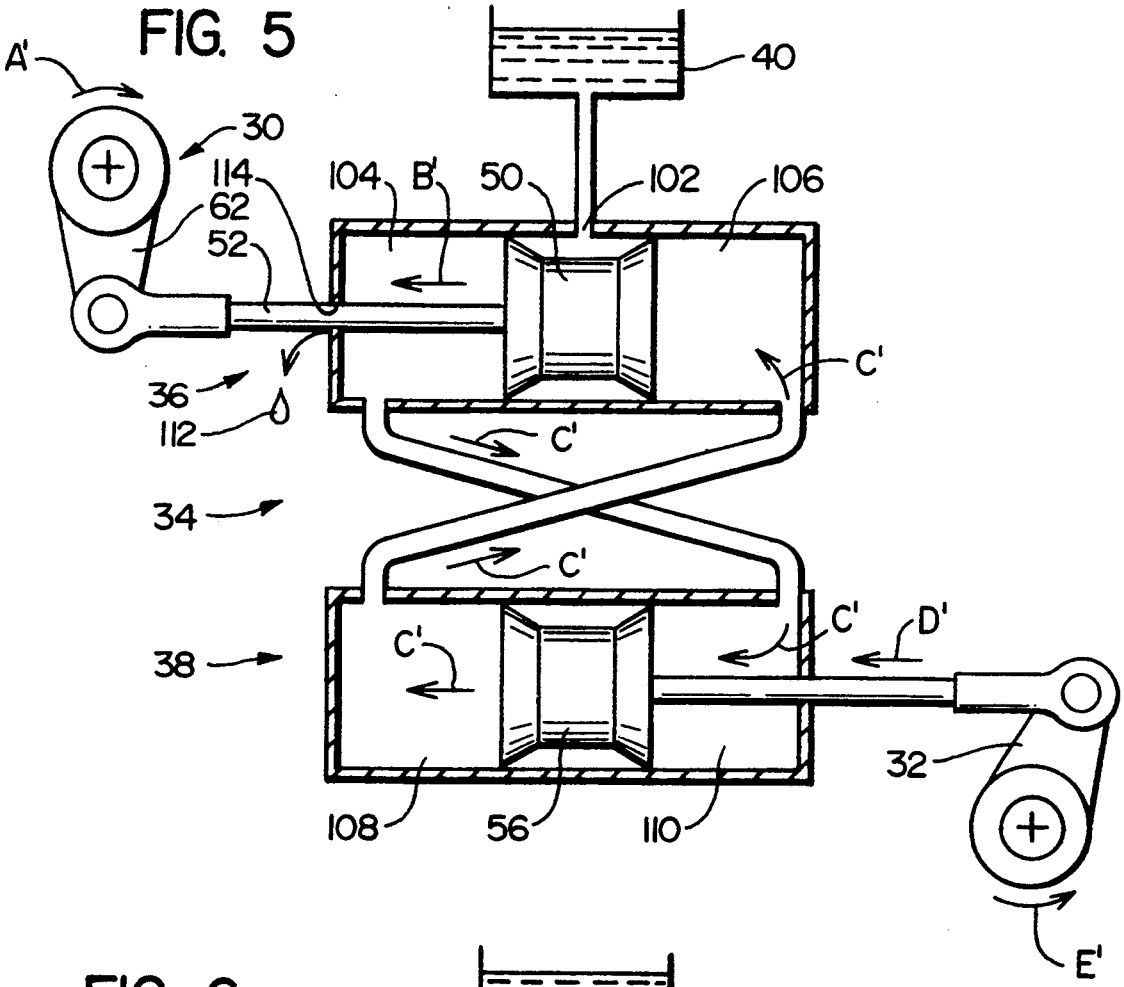

Referring now to FIG. 5, rotating the control lever 30 into the middle position as shown by arrow A' causes the master piston 50 to move as shown by arrow B'. Movement of the master piston 50 in the direction of arrow B' causes fluid to flow throughout the system 34 as shown by arrows C'. Specifically, fluid flows from the chamber 104 into the chamber 110 and from the chamber 108 into the cheer 106. The fluid filling the chamber 110 acts on the piston 56 to cause the piston 56 to move in the direction shown by arrow D'. This rotates the clutch lever 32 in the direction shown by arrow E from the reverse position into the neutral position (FIG. 5).

In this case, as the chamber 104 is pressurized, a small quantity of fluid 112 seeps out of the master casing 48 through an orifice 114 in the casing 48; the shaft 52 passes through this orifice 114. This small quantity of oil will not, by itself, causes the pistons 50 and 56 to come out of synchronism. Over time, the amount of oil leaking as shown in FIG. 5 will become significant and thus will cause the piston 56 to lag the piston 50 by a small amount; at that point, the pistons 50 and 56 will no longer be synchronized.

Figure 6:
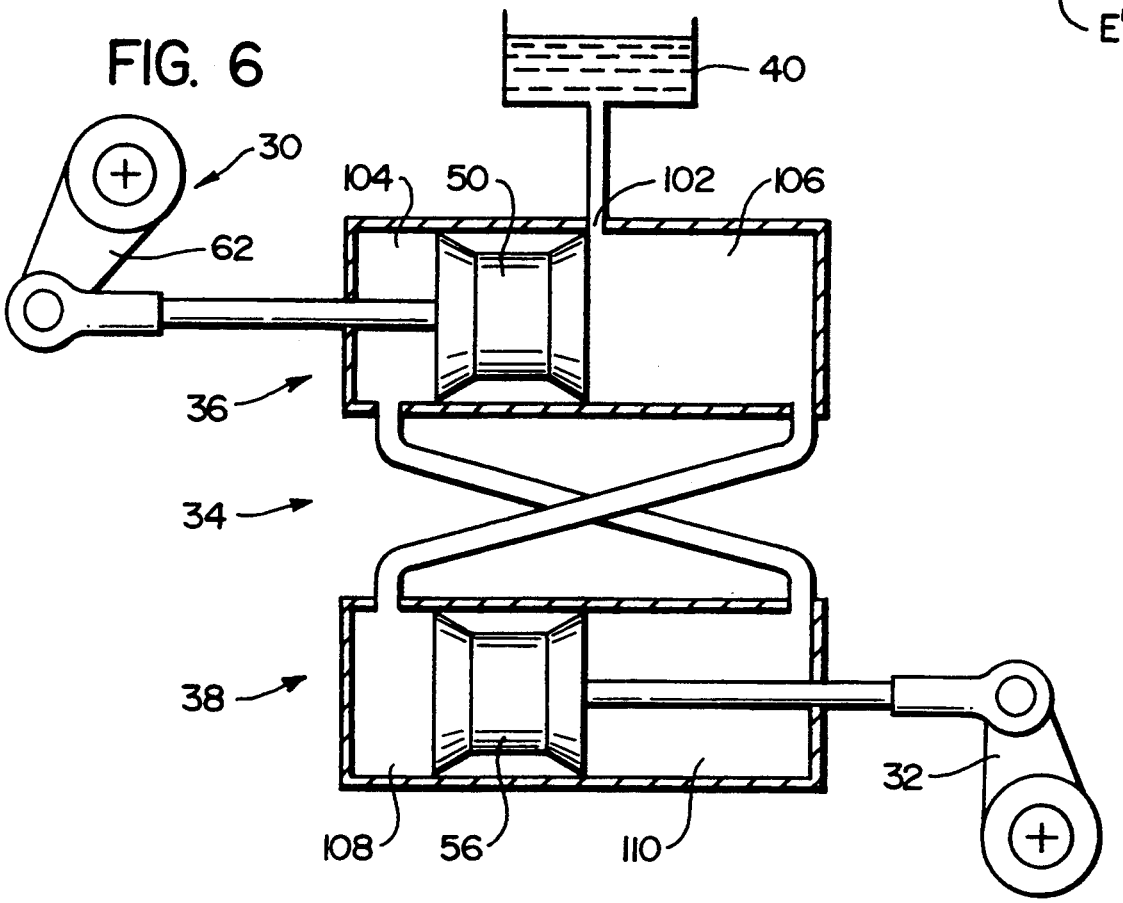
Figure 7:
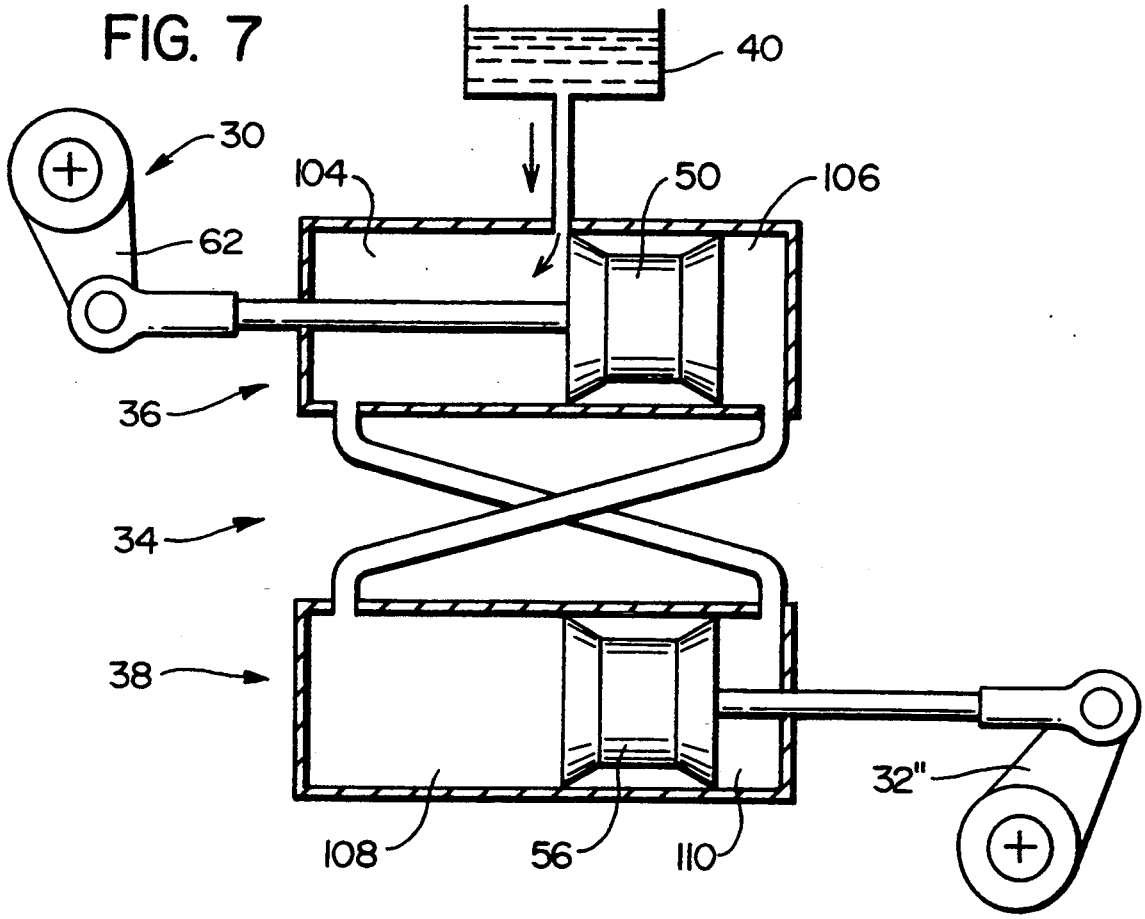
FIGS. 7–13 schematically depict the operation of a second exemplary hydraulic control system.
Figure 8:
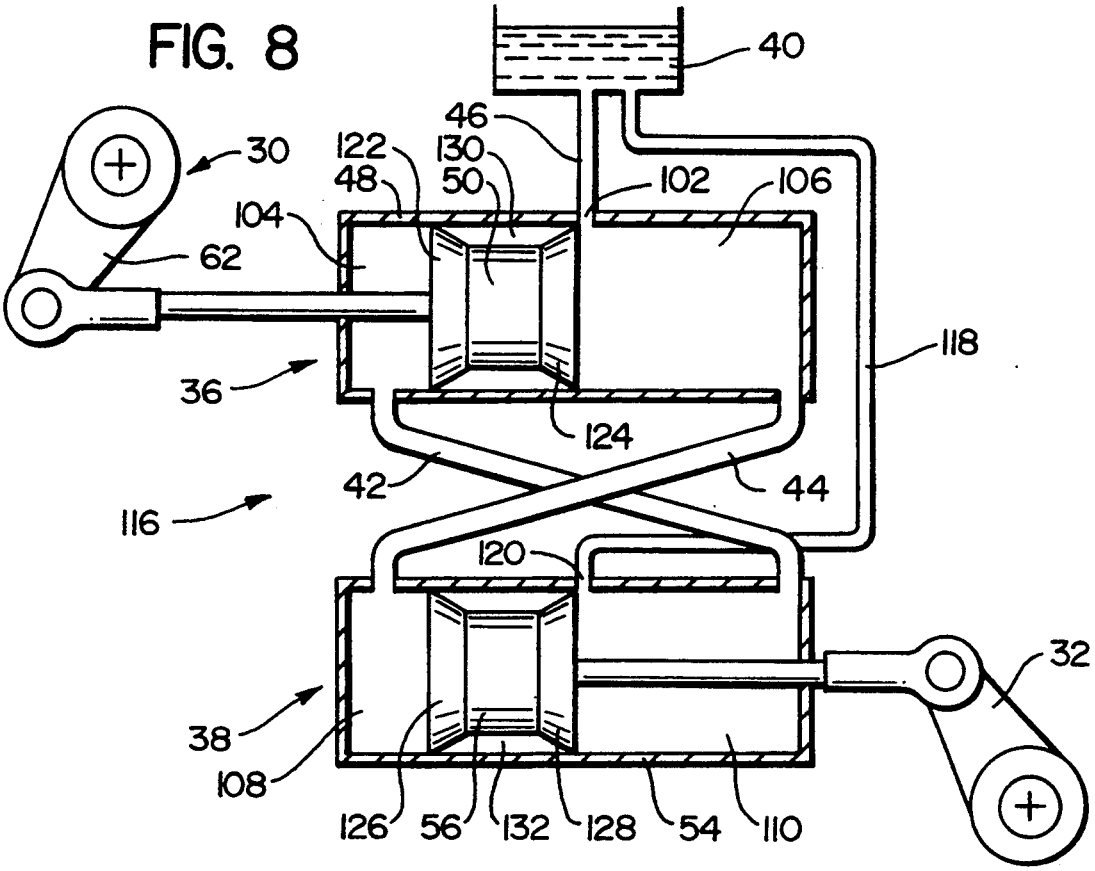
Figure 9:
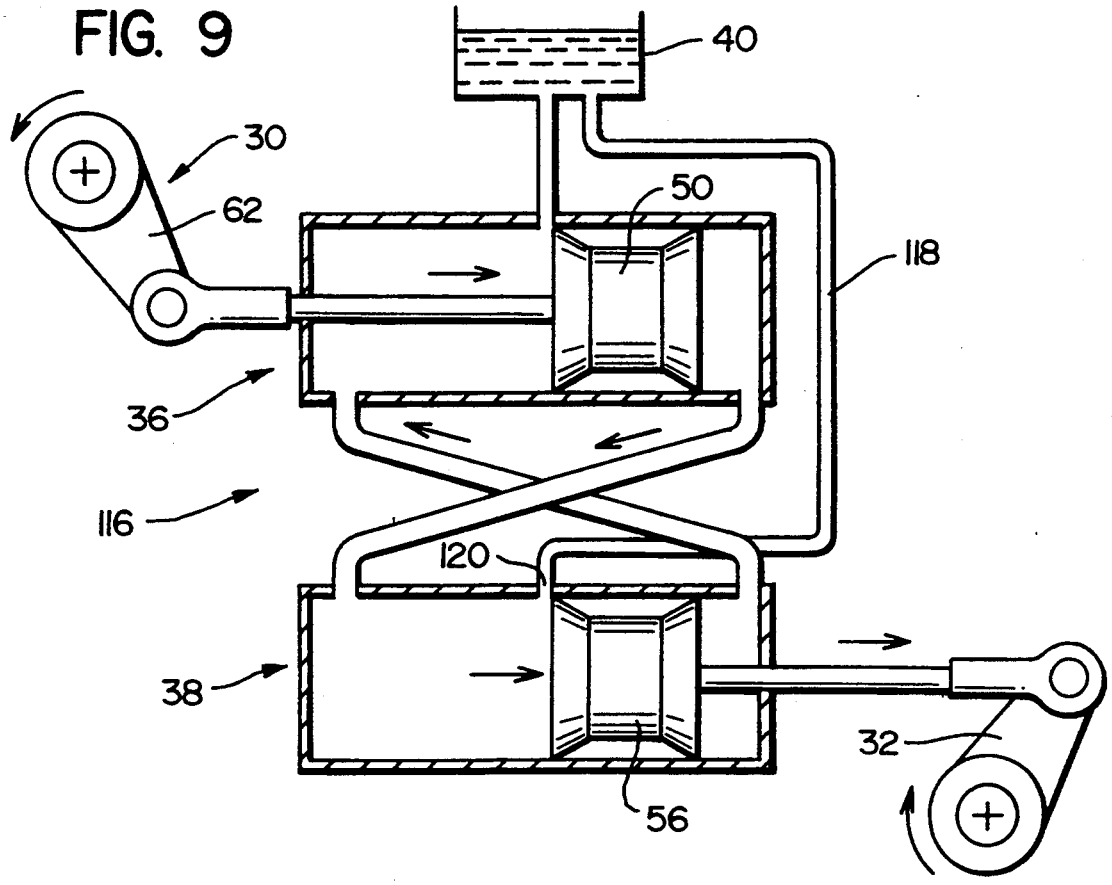

However, the exemplary control system 34 comprises the port 102 which is located to ensure that any slight leakage will be compensated for within one stroke-cycle of the master unit 36. As shown in FIG. 6, the master piston 50 is moved to the beginning of its stroke; when the piston reaches the end of its stroke as shown in FIG. 7, the piston 50 passes the port 102, allowing communication between the reservoir 40 and the first chamber 104. Any fluid lost as shown at 112 in FIG. 5 is replenished by fluid from the reservoir 40. Leakage of oil is thus not allowed to accumulate for long periods of time, and the system 34 never reaches a point at which the pistons 50 and 56 are no longer synchronized.

This system 34 is not capable of synchronizing the pistons 50 and 56 if they become severly out of synchrony such as by a catastrophic loss of system fluid; the system 34 does, however, maintain the system 34 in a synchronized state with minor and expected losses of fluid.

Referring now to FIGS. 8–13, depicted therein is another exemplary hydraulic control system 116 constructed in accordance with, and embodying, the principles of the present invention. The system 116 is employed to transfer movement of a control lever to a clutch lever in much the same way as the system 34 described above.

The system 116, however, comprises a fifth flexible pressure hose 118, which is connected between the reservoir 40 and the slave casing 54. The hose 118 is so connected to the slave casing 54 that fluid can flow from the reservoir 40 into the slave casing 54 only when the slave piston 56 is at either end of its stroke. Fluid enters into the slave piston casing 54 through a port 120.

In the system 116, the piston 50 has first and second seals 122 and 124 formed on the ends thereof and the slave piston 56 has third and fourth seals 126 and 128 formed on the ends thereof. Additionally, first and second annular chambers 130 and 132 are defined within the casings 48 and 54 around the pistons 50 and 56, respectively.

The first seal 122 allows fluid to flow from the first annular chamber 130 into the first chamber 104 but prevents fluid from flowing from the first chamber 104 into the first annular chamber 130, the second seal 124 allows fluid to flow from the first annular chamber 130 into the second chamber 106 but prevents fluid from flowing from the first chamber 106 into the first annular chamber 130, the third seal 126 allows fluid to flow from the second annular chamber 132 into the third chamber 108 but prevents fluid from flowing from the third chamber 102 into the second annular chamber 132, and the fourth seal 128 allows fluid to flow from the second annular chamber 132 into the fourth chamber 110 but prevents fluid from flowing from the fourth chamber 110 into the second annular chamber 132.

Figure 10:
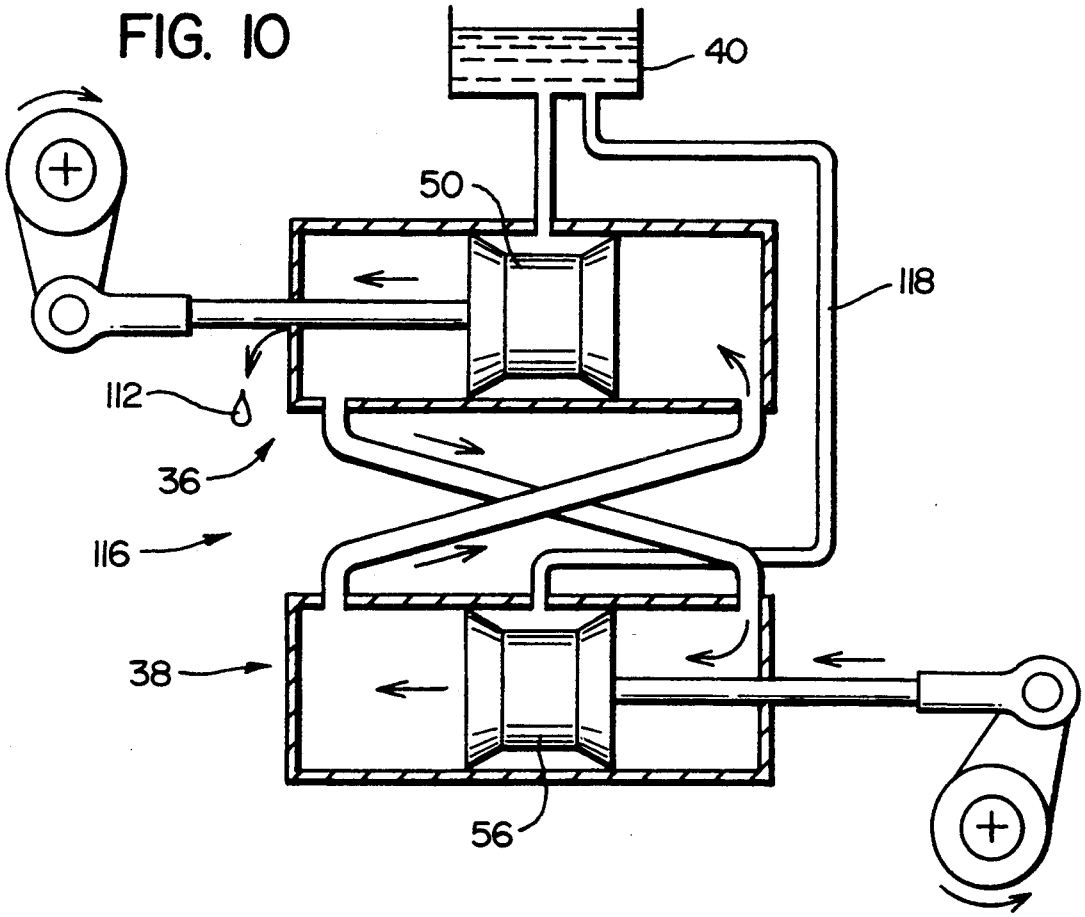
Figure 11:
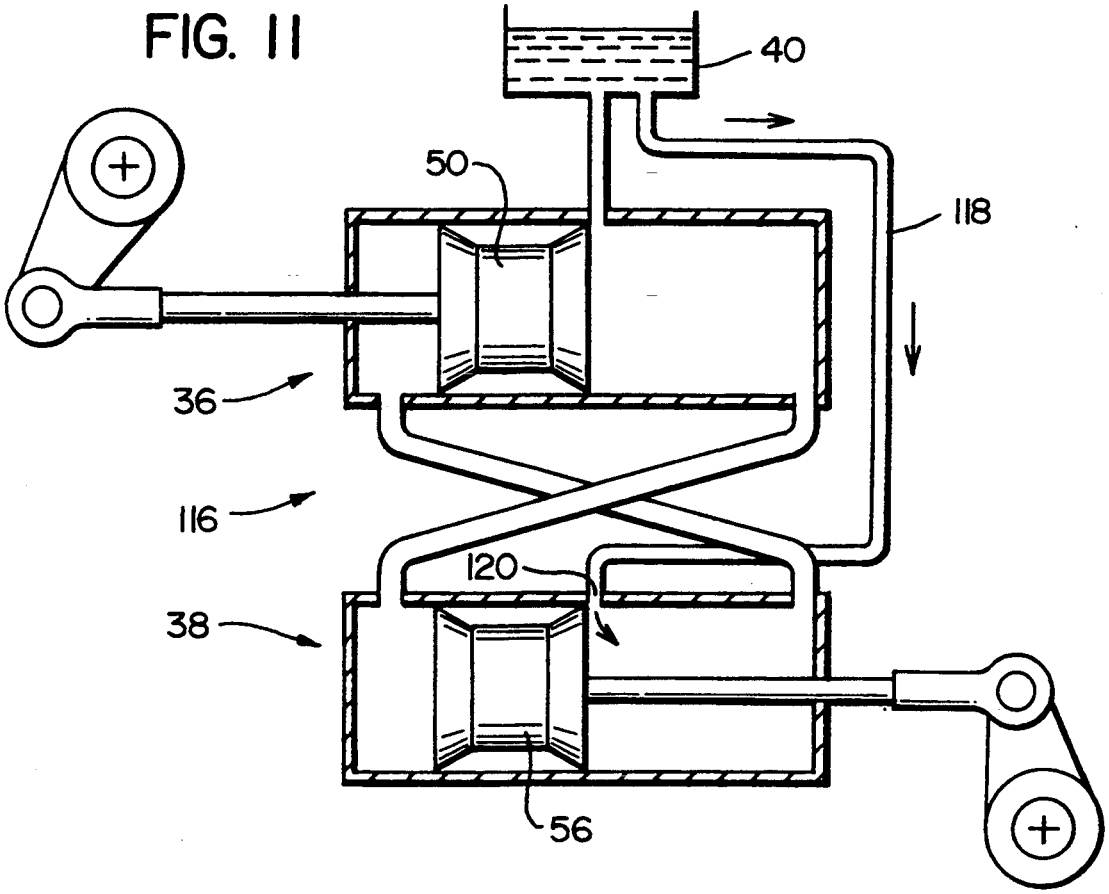

The control system 116 operates in most situations like the control system 34. However, when a minor leak occurs, such as in FIG. 10, the fluid lost is compensated for each half-cycle of the stroke of the pistons 50 and 56; as shown in FIG. 11, the fluid lost during the movement depicted in FIG. 10 is replenished almost immediately with fluid from the reservoir 40 through the fourth hose 118 and the port 120 into the slave casing 54.

Figure 12:
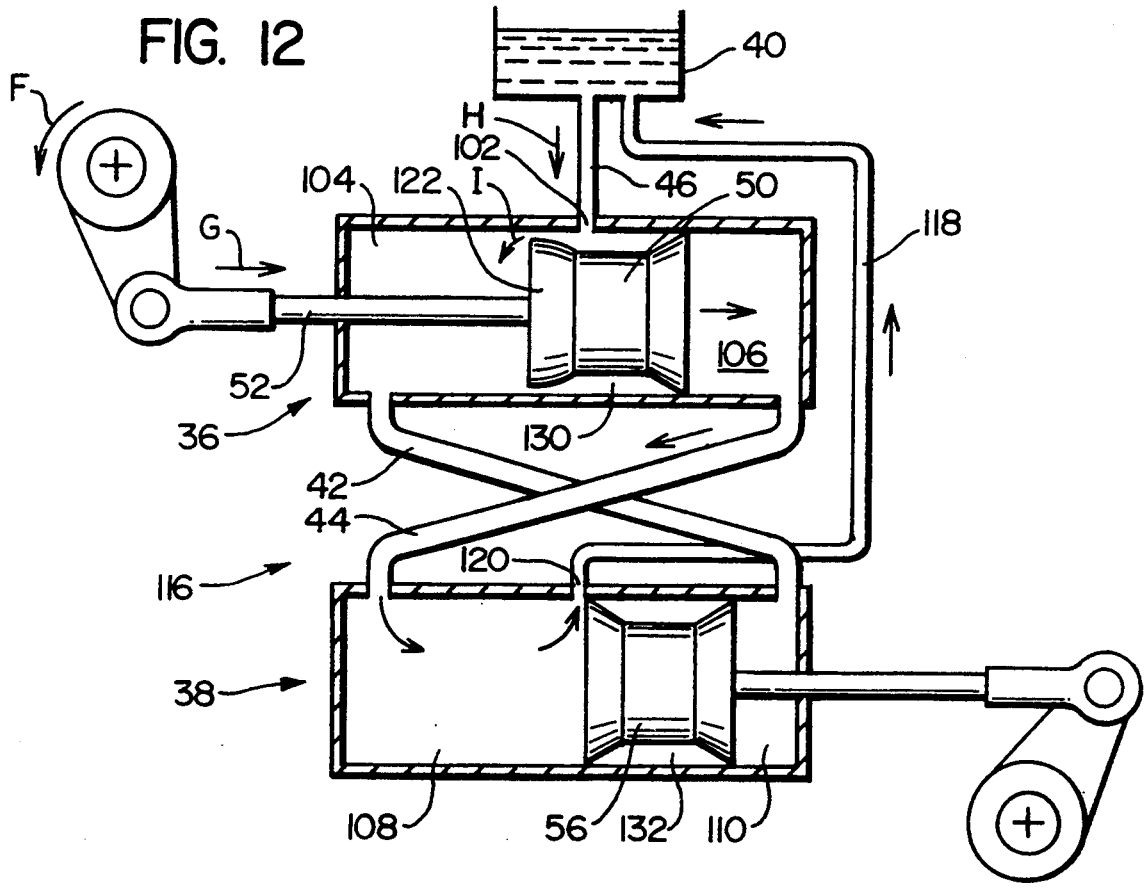

Another major difference between the control systems 34 and 116 is that the system 116 is capable of returning to synchrony the system 116 if the pistons 50 and 56 thereof are severely out of synchrony. Such a situation is depicted in FIG. 12. In that situation, the master piston 50 is lagging the slave piston 56; in other words, the amount of fluid in the in the second chamber 106, second hose 44, and third chamber 108 has become greater than the amount of fluid in the first chamber 104, first hose 42, and fourth chamber 110. This could be caused, for example, by a leak which causes the amount of fluid in the first chamber 104, first hose 42, and fourth chamber 110 to drop.

Figure 13:
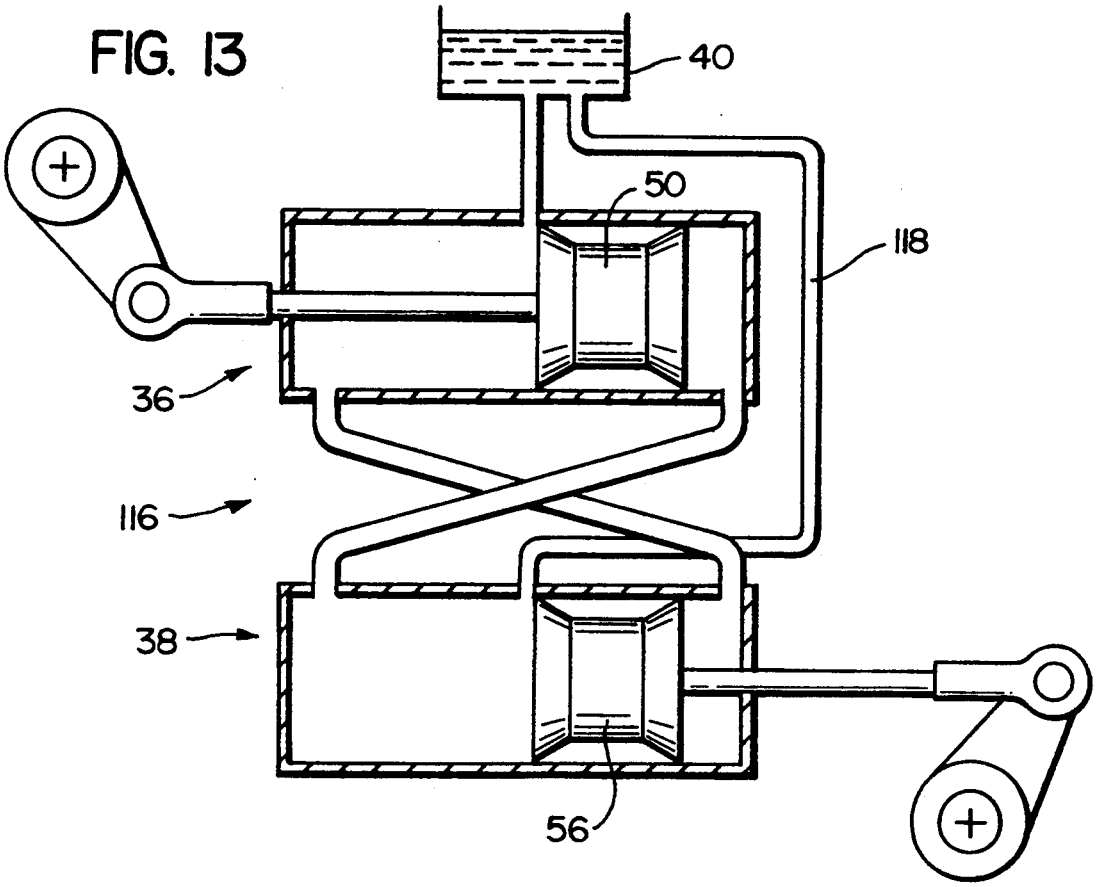

As shown in FIG. 12, rotation of the control lever as shown by arrow F causes the master piston shaft 52 and master piston 50 attached thereto to move in the direction shown by the arrow G. This creates a pressure drop in the first chamber 104, first hose 42, and fourth chamber 110 which is satisfied by fluid flow from the reservoir 40 into the first annular chamber 130 and around the first seal 122 as shown by arrows H and I. Additionally, the fluid in the second chamber 106 flows through the second hose 44, into the third chamber 108, through the port 120 in the slave casing 54, through the fourth hose 118, and into the reservoir 40. This flow of system fluid allows the master piston 50 to move while the slave piston remains stationary and thus places the system 116 back into synchrony as shown in FIG. 13. The system 116 can then be used in the normal fashion depicted in FIGS. 8 and 9.

Figure 14:
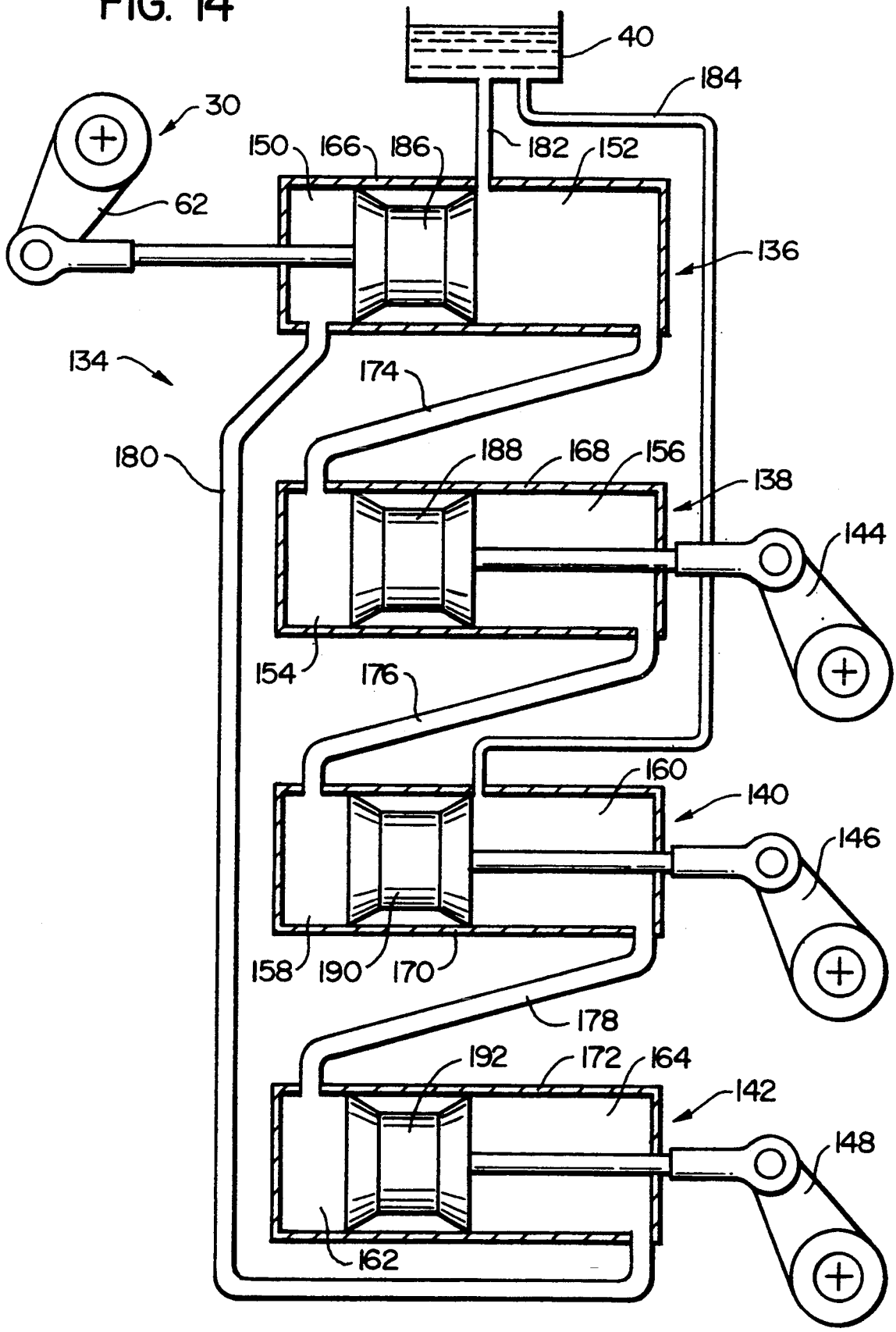
FIG. 14 schematically depicts a third exemplary hydraulic control system.

Referring now to FIG. 14, a third exemplary hydraulic control system 134 is depicted therein. This system 134 operates in the same basic manner as the system 34 described above. The system 134 comprises a master pressure unit 136 like the pressure unit 36 described above and first, second, and third slave pressure units 138, 140, and 142 like the pressure unit 38 described above. The first, second, and third slave pressure units 138, 140, and 142 are connected to first, second, and third clutch levers 144, 146, and 148. These clutch levers 144, 146, and 148 would, for example, be connected to separate marine engines such as the above-introduced engine 24.

As with the pressure units 36–38 described above, FIG. 14 shows that pairs of chambers 150–164 are defined within casings 166–72 of the pressure units 136, 138, 140, and 142, respectively. The second and third chambers 152 and 154 are connected by a first flexible pressure hose 174, the fourth and fifth chambers 156 and 158 are connected by a second flexible pressure hose 176, the sixth and seventh chambers 160 and 162 are connected by a third flexible pressure hose 178, and the eighth and first chambers 164 and 150 are connected by a first flexible pressure hose 180. As with the systems 34 and 116 described above, the master casing 166 is connected to the reservoir 40 by a fifth pressure hose 182. In this system 134, the reservoir 40 is also connected to the second slave casing 170 by a sixth flexible hose 184.

The purpose of the system 134 is to allow the movement of one control lever 30 to be transferred to the plurality of clutch levers 144, 146, and 148. To that end, the hoses 150, 152, and 154 are arranged to allow fluid communication between the various chambers 150-164 that movement of a master piston 186 in the master casing 166 in one direction causes fluid to act on slave pistons 188, 190, and 192 in the slave casings 168, 170, and 172 to move those slave pistons 188, 190, and 192 in one direction and movement of the master piston 186 in another direction causes fluid to act on the slave pistons 188, 190, and 192 to move those slave pistons 188, 190, and 192 in another direction. The flow of fluid that accomplishes this should be clear from the above discussions of the systems 34 and 116.

As with the system 34 described above, this system 134 will compensate for minor loss of fluid but will not place the system back into synchronism once any of the pistons lead or lag the other pistons. However, it should be clear that by applying the teachings of the system 116 to the system 134 (i.e., connecting the reservoir 40 to the first and third slave casings 168 and 172 and providing one-way seals on the ends of the pistons 186–192), the system 134 could be made to place itself back into synchrony.

From the foregoing, it should be clear that the present invention may be embodied in forms other than those disclosed above without departing from the spirit or essential characteristics of the present invention. For example, by applying the teachings of the system 116 to the system 134 (i.e., connecting the reservoir 40 to the first and third slave casings 168 and 172 and providing one-way seals on the ends of the pistons 186–192), the system 134 could be made to place itself back into synchrony.

The above description is therefore to be considered in all respects illustrative and not restrictive, the scope of the invention being indicated by the appended claims rather than the foregoing description. All changes that come within the meaning and scope of the claims are intended to be embraced therein.

I claim:

1. An apparatus for connecting a marine engine to a propellor shaft comprising:

a. first transmission means for selectively allowing the engine to rotate the propellor shaft in a first direction, to rotate the propellor shaft in a second direction, or to prevent the engine from rotating the propellor shaft;

b. a first lever;

c. a second lever, where rotation of the second lever directs the transmission means to allow the engine to rotate the propellor shaft in a first direction, rotate of the propellor shaft in the second direction, or prevent rotation of the propellor shaft; and d. means for transmitting rotation of the first lever to the second lever comprising i. first casing means for containing flowable working medium, ii. second casing means for containing flowable working medium, iii. first piston means movably mounted in the first casing means for defining first and second chambers within the first casing means, volumes of the first and second chambers changing as the first piston means moves within the first casing means, where the first lever is so connected to the first piston means that rotation of the first lever displaces the first piston means within the first casing means, iv. second piston means movably mounted in the second casing means for defining third and fourth chambers in the second casing means, volumes of the third and fourth chambers changing as the second piston means moves within the second casing means, where the second lever is so connected to the second piston means that displacement of the second piston means within the second casing means causes rotation of the second lever, v. first means for allowing fluid communication between the second and third chambers, vi. second means for allowing fluid communication between the first and fourth chambers, vii. flowable working medium contained within the first through fourth chambers and the first and second fluid communication means, viii. reservoir means for containing additional flowable working medium;

ix. a first port located in the first casing means, and x. third means for allowing fluid communication between the reservoir means and the first port, where the first port is so located in the first casing means that fluid can flow from the reservoir means into the first chamber only when the volume of the second chamber is substantially at a minimum and from the reservoir means into the second chamber only when the volume of the first chamber is substantially at a minimum; wherein movement of the first piston in a first direction causes fluid to flow from the first chamber into the fourth chamber to move the second piston in a second direction; and movement of the first piston in a third direction causes fluid to flow from the second chamber into the third chamber to move the second piston in a fourth direction.

2. An apparatus as recited in claim 1, in which the rotation transmitting means further comprises:

a. first shaft means for allowing displacement of the first piston means, the first shaft means extending through a first shaft orifice in the first casing means;

b. second shaft means for allowing displacement of the second piston means to be transferred to the exterior of the second casing means, the second shaft means extending through a second shaft orifice in the second casing means; wherein flowable working medium within the first and second casing means lost through the first and second shaft orifices is replaced by fluid from the reservoir means.

3. An apparatus as recited in claim 1, in which:

a. the first lever is mounted adjacent a steering mechanism of a craft in which the marine engine is mounted; and b. the second lever is mounted adjacent to the marine engine, where the engine is mounted at a location distal from a location of the steering mechanism.

4. An apparatus as recited in claim 1, in which the rotation transmitting means further comprises:

a. a second port located in the second casing means; and b. fourth means for allowing fluid communication between the reservoir means and the second port, where the second port is so located in the second casing means that fluid can flow from the reservoir means into the third chamber only when the volume of the fourth chamber is substantially at a minimum and from the reservoir means into the fourth chamber only when the volume of the third chamber is substantially at a minimum.

5. An apparatus as recited in claim 4, in which:

a. a first annular chamber is defined around the first piston within the first casing means, where the first port is so located in the first casing means that fluid can flow from the reservoir means into the first annular chamber when the volumes of the first and second chambers are not substantially at a minimum; and b. a second annular chamber is defined around the second piston within the second casing means, where the second port is so located in the second casing means that fluid can flow from the reservoir means into the second annular chamber when the volumes of the third and fourth chambers are not substantially at a minimum;

c. a first sealing means is mounted on a first end of the first piston for preventing fluid from flowing from the first chamber into the first annular chamber and for allowing fluid to flow from the first annular chamber to the first chamber;

d. a second sealing means is mounted on a second end of the first piston for preventing fluid from flowing from the second chamber into the first annular chamber and for allowing fluid to flow from the first annular chamber to the second chamber;

e. a third sealing means is mounted on a first end of the second piston for preventing fluid from flowing from the third chamber into the second annular chamber and for allowing fluid to flow from the second annular chamber to the third chamber; and f. a fourth sealing means is mounted on a second end of the second piston for preventing fluid from flowing from the fourth chamber into the second annular chamber and for allowing fluid to flow from the second annular chamber to the fourth chamber.

6. A self-synchronizing hydraulic control system comprising:

a. first casing means for containing flowable working medium, b. second casing means for containing flowable working medium, c. first piston means movably mounted in the first casing means for defining first and second chambers within the first casing means, volumes of the first and second chambers changing as the first piston means moves within the first casing means, where the first lever is so connected to the first piston means that rotation of the first lever displaces the first piston means within the first casing means, d. second piston means movably mounted in the second casing means for defining third and fourth chambers in the second casing means, volumes of the third and fourth chambers changing as the second piston means moves within the second casing means, where the second lever is so connected to the second piston means that displacement of the second piston means within the second casing means causes rotation of the second lever, e. first means for allowing fluid communication between the second and third chambers, f. second means for allowing fluid communication between the first and fourth chambers, g. flowable working medium contained within the first through fourth chambers and the first and second fluid communication means, h. reservoir means for containing additional flowable working medium;

i. a first port located in the first casing means, and j. third means for allowing fluid communication between the reservoir means and the first port, where the first port is so located in the first casing means that fluid can flow from the reservoir means into the first chamber only when the volume of the second chamber is substantially at a minimum and from the reservoir means into the second chamber only when the volume of the second chamber is substantially at a minimum;

k. first shaft means for allowing displacement of the first piston means, the first shaft means extending through a first shaft orifice in the first casing means;

l. second shaft means for allowing displacement of the second piston means to be transferred to the exterior of the second casing means, the second shaft means extending through a second shaft orifice in the second casing means; wherein movement of the first piston in a first direction causes fluid to flow from the first chamber into the fourth chamber to move the second piston in a second direction and movement of the first piston in a third direction causes fluid to flow from the second chamber into the third chamber to move the second piston in a fourth direction; and flowable working medium within the first and second casing means lost through the first and second shaft orifices is replaced by fluid from the reservoir means.

7. A control system as recited in claim 6, further comprising:

a. first lever means so connected to the first shaft means that rotation of the lever displaces the first shaft means; and b. second lever means so connected to the second shaft means that movement of the second shaft means rotates the second lever means.

8. A control system as recited in claim 7, in which the second lever means is so connected to a clutch control valve shaft that rotation of the second lever means causes rotation of the clutch control valve shaft.

9. A control system as recited in claim 8, in which the clutch control valve shaft controls an engine, where the clutch control valve shaft rotates among a first position in which the engine is in reverse, a second position in which the engine is in neutral, and a third position in which the engine is in forward.

10. An apparatus as recited in claim 6, in which the rotation transmitting means further comprises:

a. a second port located in the second casing means; and b. fourth means for allowing fluid communication between the reservoir means and the second port, where the second port is so located in the second casing means that fluid can flow from the reservoir means into the third chamber only when the volume of the fourth chamber is substantially at a minimum and from the reservoir means into the fourth chamber only when the volume of the third cheer is substantially at a minimum.

11. An apparatus as recited in claim 10, in which:

a. a first annular chamber is defined around the first piston within the first casing means, where the first port is so located in the first casing means that fluid can flow from the reservoir means into the first annular chamber when the volumes of the first and second chambers are not substantially at a minimum; and b. a second annular chamber is defined around the second piston within the second casing means, where the second port is so located in the second casing means that fluid can flow from the reservoir means into the second annular chamber when the volumes of the third and fourth chambers are not substantially at a minimum;

c. a first sealing means is mounted on a first end of the first piston for preventing fluid from flowing from the first chamber into the first annular chamber and for allowing fluid to flow from the first annular chamber to the first chamber;

d. a second sealing means is mounted on a second end of the first piston for preventing fluid from flowing from the second chamber into the first annular chamber and for allowing fluid to flow from the first annular chamber to the second chamber;

e. a third sealing means is mounted on a first end of the second piston for preventing fluid from flowing from the third chamber into the second annular chamber and for allowing fluid to flow from the second annular chamber to the third chamber; and f. a fourth sealing means is mounted on a second end of the second piston for preventing fluid from flowing from the fourth chamber into the second annular chamber and for allowing fluid to flow from the second annular chamber to the fourth chamber.

* * * * *